US005448937A

United States Patent [19]

Buc et al.

[11] Patent Number: 5,448,937

[45] Date of Patent: Sep. 12, 1995

[54] MUZZLE LAUNCHED GRAPNEL HOOK PROJECTILE

[76] Inventors: Steven M. Buc, 53 Lake Park Ct., Germantown, Md. 20874; Stephen Adelman, 1011 Maxwell Ct., Manassas, Va. 22110

[21] Appl. No.: 289,661

[22] Filed: Aug. 12, 1994

[51] Int. Cl.[6] ..... F42B 12/02

[52] U.S. Cl. ..... 89/1.34; 89/1.13; 102/402

[58] Field of Search ..... 102/504, 398, 400, 425, 102/403, 485, 501, 402; 89/1.34, 1.13

[56] References Cited

U.S. PATENT DOCUMENTS

| | | | |
|---|---|---|---|
| 331,792 | 12/1885 | Ingersoll | 89/1.34 |
| 1,020,366 | 3/1912 | Olsen | 89/1.34 |
| 1,139,916 | 5/1915 | Stoehr et al. | 102/400 |
| 1,300,708 | 4/1919 | Edison | 102/400 |
| 1,315,721 | 9/1919 | Hall | 102/504 |
| 2,055,506 | 9/1936 | Schlumberger | 102/504 |
| 3,572,250 | 3/1971 | Kriesel et al. | 102/398 |
| 4,505,179 | 3/1985 | Nelson et al. | 89/1 |
| 4,653,379 | 3/1987 | Barret et al. | 102/504 |
| 4,776,255 | 10/1988 | Smith | 89/1.13 |
| 4,799,906 | 1/1989 | Perkins | 102/504 |
| 4,967,636 | 11/1990 | Murray et al. | 89/1.13 |
| 5,035,169 | 7/1991 | Chapin et al. | 89/1.34 |
| 5,052,636 | 10/1991 | Chester | 102/504 |
| 5,069,136 | 12/1991 | Axelson et al. | 102/425 |
| 5,099,747 | 3/1992 | Smith | 89/1.13 |
| 5,368,255 | 11/1994 | August | 102/400 |

FOREIGN PATENT DOCUMENTS

| | | | |
|---|---|---|---|
| 838287 | 3/1939 | France | 102/400 |

*Primary Examiner*—Charles T. Jordan

[57] ABSTRACT

A muzzle launched grapnel hook projectile having a body with an internal cavity which is sized to fit over the muzzle end of a rifle or spigot. A bullet trap within the internal cavity permits launching of the projectile one time with a live bullet cartridge as the propulsion force. The projectile can then be launched multiple times with a blank propellant cartridge. The front of the projectile mounts several torsion springs which serve as tines to grab trip wires and detonate trip wire mines as the projectile is being dragged back to the launch point. The torsion spring design and mounting scheme permits the tine to bend and release from non-trip wire obstacles along the retrieval path. Attached to the base of the projectile at a flange is a bridle consisting of multiple leader lines. Pulling on the bridle causes the leader lines to come together to form a cone-like surface which allows the base of the projectile to slide easily over obstacles. Attached to the bridle assembly is a retrieval line, which is made from mono-filament or twisted ribbon plastic material wound into a unique spool, which permits the line to be pulled out without snagging and with minimal friction resulting in a long projectile trajectory range.

20 Claims, 6 Drawing Sheets

MUZZLE LAUNCHED GRAPNEL HOOK PROJECTILE

BACKGROUND OF THE INVENTION

1. Field of the Invention

The invention relates to land mine clearing devices, and more specifically to muzzle launched grapnel hook projectiles, which contain therein projectile bodies, bullet traps, bridles, retrieval lines, and tines which catch and pull trip wires thus causing land mine detonation at a safe distance.

2. Description of the Prior Art

Heretofore, rifle and spigot muzzle launched projectiles utilizing bullet traps, blank propellant cartridges, or rocket motors as the propulsion force were utilized to propel explosive warheads, to launch harpoons, to throw lines, ropes and ladders for climbing and life saving, and to pay out explosive lines for clearing battlefield obstacles and land mines. Muzzle launched projectiles employing explosive warheads are generally termed rifle grenades and are related to this invention only by the common rifle or spigot launching mechanism. Exploding warhead rifle grenades do not deploy any retrieval line as they fly to the target, nor are they dragged back to the launch point after impact. Harpoons employ a retrieval line. However, the design of the harpoon projectile is such that it does not release from its target after impact and penetration. The target is, therefore, retrieved along with the harpoon projectile. Life saving and line throwing devices employ a projectile and throw a line but are designed for the safe and easy retrieval of a person or object. Projectiles used for throwing lines and ladders for climbing typically employ a rigid grapnel which will hook onto an obstacle and not release under the weight of the climber. A rigid grapnel hook projectile cannot be retrieved and no trip wire land mines can be detonated with this type of grapnel hook projectile. Projectiles designed to deploy and detonate an explosive filled line for the purposes of clearing pressure sensitive land mines are related to this invention only by the common launching mechanism, a spigot or rifle, firing a live bullet or a blank projectile cartridge.

This invention is significantly different from the prior art in that it deploys a unique retrieval line and unique grapnel hook tines which, when pulled back to the point of launch, will grab land mine trip wires, causing the land mine to detonate, but will release if it grabs a non-trip wire object along the path. Incorporating tines, which will grab trip wires but release when hooking other objects, into a muzzle launched projectile that deploys a low friction retrieval line results in the use of design methodologies heretofore unpracticed.

Accordingly, it is advantageous to provide a muzzle launched projectile for use with rifles and spigots firing live bullets and blank projectile cartridges, which incorporates a low friction retrieval line and unique tines that will catch and pull trip wires but release on non-trip wire objects, thus allowing a soldier to clear a safe lane through a minefield.

SUMMARY

Accordingly, several objects and advantages of our invention are to provide a Muzzle Launched Grapnel Hook Projectile which overcomes the problems set forth in detail herein above.

The projectile assembly of this invention is made up of a cylindrical body of length substantially longer than its greatest external diameter, having a base flange with an attached bridle and retrieval line, a central cylindrical portion with a reduced external diameter, and a forward portion with several torsion springs distributed about the circumference. The body of the projectile has an internal cavity opening at the base, and a bullet trap located at the front of the internal cavity, The internal cavity is sized to fit with a small clearance over the muzzle of the firing device. This diameter is typically 22 millimeters for standard military rifles. The depth of the internal cavity is sufficient to permit the body to slide several inches over the barrel of the firing device. Standard military rifles offer about six inches of unrestricted barrel length at the muzzle. Taking full advantage of the available barrel length is important to realizing the highest launch velocity of the projectile, since the primary propulsion force is the entrapped propellant gas pressure from the firing cartridge.

The body acts as a pressure vessel when it traps the cartridge propellant gas pressure and should be made from a material with high strength to weight, so that it does not rupture and can be launched with a reasonable muzzle velocity. Inside the body cavity, internal pressures from standard rifles can reach 10,000 pounds per square inch. This pressure will rapidly decrease due to adiabatic expansion as the projectile slides off the muzzle, so that the wall thickness is reduced along the central cylindrical portion. Reducing the body diameter in the region of lower internal pressure provides the advantage of lowering the projectile parasitic weight, ensuring an optimal launch velocity and trajectory range. Using a standard military rifle, a one half pound muzzle launched grapnel hook projectile can be launched at about 100 meters per second velocity and tow a retrieval line to approximately 100 meters. Depending on the exact projectile weight, launch accelerations due to pressure alone can reach as high as 12,000 times that of gravity. Heat treated aluminum alloy is an appropriate material choice for the projectile body.

It is advantageous to fire the muzzle launched grapnel hook projectile from a standard military rifle using live service ammunition. The bullet trap at the front of the internal cavity safely stops the bullet and mitigates launch accelerations when firing live ammunition. Nevertheless, bullet impact can result in maximum launch accelerations of 40,000 times that of gravity, depending on the bullet trap design. Bullets containing steel or armor piercing cores, as opposed to soft lead fillers, require the use of a hardened steel anvil to stop the core from penetrating through the projectile body. A lead filled bullet can be safely stopped with an aluminum cylinder as a bullet trap. To stop steel core bullets, a hardened steel cup-shaped anvil is placed behind and conforming to the aluminum bullet trap. Since the momentum in the bullet represents only about twelve percent more launch velocity for the projectile, a blank propellant cartridge is also useful for launching the projectile. When using a blank propellant cartridge, a bullet trap is not necessary. The use of blank propellant cartridges permits re-use of the projectile after it is retrieved. Multiple re-use with blank cartridges is also possible after one firing with a live bullet into the bullet trap. The ability to re-use the grapnel hook projectile is advantageous when clearing many lanes through a wide or deep minefield.

Unlike the present series of line throwing projectiles, this invention uses torsion springs as tines to grab trip wires and detonate trip wire fuzed mines as the projectile is retrieved. These torsion springs are configured to release if the tine prong snags on an object other than a trip wire, and to release from wire obstacles if pulled on with a force greater than that required to detonate a trip wire mine.

The use of torsion springs as tines to grab trip wires is unique and advantageous, since the grapnel will release from large objects it has snagged, yet retain trip wires with sufficient force to detonate the land mine. Used in this configuration, the torsion spring is a sophisticated mechanism providing complex motion with simplicity and economy in design. Each torsion spring is attached to the forward portion of the body by having one of its free ends secured into a drill hole. This free end can be secured into the hole with an anaerobic adhesive, a shrink fit, or a threaded or brazed connection. The other free end of the torsion spring serves as a prong to grab the trip wire, and is oriented towards the base of the body at an acute angle. The torsion spring coil may be located at the greatest external diameter of the forward body, or it may be recessed for enhanced protection when the projectile impacts the ground. Protecting the torsion spring coil from damage provides the advantage of permitting the grapnel hook projectile to be re-used multiple times. Recessing the spring coil also provides advantages by changing the resistance force of the spring when opening on various obstacles. There are many ways to recess the spring coil, from a simple cylindrical undercut below the major diameter to a more complicated horizontal slit in the body. Cost differences to manufacture various configurations should be considered. The performance tradeoffs in selecting a recess configuration include where the trip wire or obstacle catches the prong and the resulting torsional forces opening the spring. Another tradeoff is whether the spring is to open when catching wire obstacles such as barbed wire, or if only large obstacles such as rocks and sticks are of concern. Recessing the spring coil provides varying advantages depending on the performance and manufacturing cost requirements. Whatever the choice, the spring stiffness is selected at a minimum to be sufficient to prevent it from opening under the resistance force of a trip wire before it has had a chance to detonate the associated land mine.

Unlike the present series of line throwing projectiles, the projectile body of this invention has a base flange providing a location to affix a bridle and retrieval line. The bridle consists of several leaders. A multi-leader bridle is advantageous and permits the flat base of the projectile to slide easily over obstacles and trip wires without catching on them. Each strand of leader is threaded through an individual hole drilled in the base flange and then crimped securely back onto itself. All of the free leader ends of the bridle are then gathered together and attached to the retrieval line. When pulling on the bridle with the retrieval line, the bridle leaders come together to form a cone-like surface that slides the base of the projectile over the obstacle so that the tines can then grab at it. The leader line material should have sufficient strength, low weight, and adequate flexibility to withstand the maximum expected launch accelerations. Thin, about three sixty-fourths of an inch thick, high strength steel cable or woven nylon twine are acceptable bridle leader materials for strength and weight requirements. However, nylon twine is very flexible, and when the projectile impacts the ground, a nylon twine bridle may bunch up and foul on the projectile tines, making proper retrieval and trip wire snagging difficult. Fouling of the bridle on the projectile tines during impact is successfully avoided when using the thin steel cable bridle leaders. The steel cable is adequately flexible to function as a bridle leader, yet sufficiently stiff to prevent the bridle from bunching during impact. As a result there is little chance of fouling the bridle and retrieval line after projectile impact on the ground.

Unlike the present series of line throwing projectiles, the selection of the retrieval line material and configuration is critical with this invention for efficient projectile flight and to achieving sufficient range when firing from a standard military rifle or spigot. Unlike the present series of line throwing projectiles, this invention ensures that the retrieval line deploys with minimal resistance and avoids snagging. Given the relatively high launch velocity of the muzzle launched grapnel hook, approximately 300 feet per second from a standard military rifle, and the high launch acceleration, about 40,000 times that of gravity, the retrieval line material and spool configuration must be properly selected to avoid having the line tangle upon itself as it deploys. If the line tangles, it can break or snag on the spool. If the line breaks, the projectile will be lost. If the line snags on the spool, the entire spool will be propelled downrange, greatly slowing the projectile and reducing its useful minesweeping range. Either condition is undesirable for both safety and performance reasons. The present series of line throwing projectiles, which have lower launch velocities and softer launch accelerations, use retrieval line materials and spool configurations which are not effective with this invention. Therefore, two acceptable retrieval line options are presented as part of this invention. Each of these retrieval line options provide unique advantages with different strength, cost, and packaging requirements.

The first retrieval line option is a heavy duty monofilament plastic material such as nylon or polypropylene with a line diameter from one to two millimeters. Whereas most cords, ropes, and twines are made from a weave or twist of multiple strands or fibers, mono-filament line consists of one strand. Common mono-filament lines are fishing line and weed-whacker line. For this application thick mono-filament lines are appropriate for strength and grip. The mono-filament retrieval line is cylindrically wound one strand thick and heated to set up as a large coil, so that it always end-feeds. 125 yards of line will fit into a coil about eight inches in diameter and ten inches high. This length of line is sufficient for the maximum range of the grapnel hook projectile. The thick mono-filament line is self standing in this configuration and cannot snag as it is pulled out. This first option is bulky, but the line is significantly stronger, more than twice as strong, as the second option. Depending on the application, great strength in the retrieval line may be an important consideration.

The second option is to use a twisted ribbon twine made from plastic material, tightly wound with a coreless spool. The spool is very small for the length of line, about four inches in length and three inches in diameter for 125 yards of line, and is self standing. The coreless wind permits the line to be pulled out from the center of the spool. The use of a twisted ribbon plastic line pulling out from the center of a coreless wind provides the least amount of friction during projectile flight, with a very light line for maximum range. A twisted ribbon plastic line is a unique retrieval line material. The line is manufactured as a thin, flat extruded ribbon which is then twisted slightly to give it a round form. The great advantage of the twisted ribbon line is that the fiber grain is in the line direction so there is very little surface friction. The low surface friction of this line configuration permits it to be wound into a spool for convenient packaging, and still dispense without snagging or significantly slowing down the projectile. For use with the muzzle launched grapnel hook, a twisted ribbon line with a diameter from one to two millimeters is sufficient for strength and grip. The most common commercially available twisted ribbon plastic line, which performs superbly with the muzzle launched grapnel hook, is called ribbon polypropylene. The break strength of ribbon polypropylene with a line diameter of about one and one half millimeters is about 80 pounds, and is adequate for trip wire mine clearing purposes.

Both retrieval line options in this invention are capable of re-use after the grapnel hook is pulled back to the shooter. The mono-filament line will naturally re-coil itself as it is accumulated. The twisted ribbon line can be carefully piled, and due to its very low surface friction will easily deploy again without snagging when the projectile is fired. The projectile is re-used with a blank propellant cartridge, since the bullet trap can only be used once with a live cartridge. Using a retrieval line which can be re-used multiple times provides a unique advantage when clearing many lanes through a large minefield or several minefields. Re-use of the retrieval line is a significant advantage of this invention.

It is an object of this invention to provide a muzzle launched grapnel hook projectile which incorporates therein a projectile body with an internal cavity that fits over the free end of a rifle or spigot barrel; the base of this projectile body has a flange for the attachment of a multi-leader bridle assembly and a retrieval line; and the front of this projectile body provides an external surface with or without recesses for the attachment of torsion springs which act as tines to grab land mine trip wires.

It is still another objective of this invention to provide a multi-leader bridle assembly which when pulled with the retrieval line forms a cone-like surface allowing the projectile base to slide over obstacles without snagging on them.

It is still another objective of this invention to provide a retrieval line which deploys with minimal resistance to the projectile flight.

It is still another objective of this invention to provide a bullet trap inside the internal cavity of the projectile body so that live cartridges can be fired from a rifle or spigot as the propulsion mechanism of the projectile.

It is still another objective of this invention to provide torsion springs attached to the front of the projectile body, which will detonate trip wire mines when snagged and pulled, but will release from other obstacles as the projectile is dragged back to the place of launch.

These and other objects of the invention will be better understood by reference to the following detailed descriptions, accompanying drawings, and claims.

BRIEF DESCRIPTION OF THE DRAWINGS

The specification concludes with a claim particularly pointing out and distinctly claiming the subject matter of the present invention. However, it is believed that the invention will be better understood from the following description taken in connection with the accompanying drawings in which:

DESCRIPTION OF THE PREFERRED EMBODIMENTS

Figure 1:
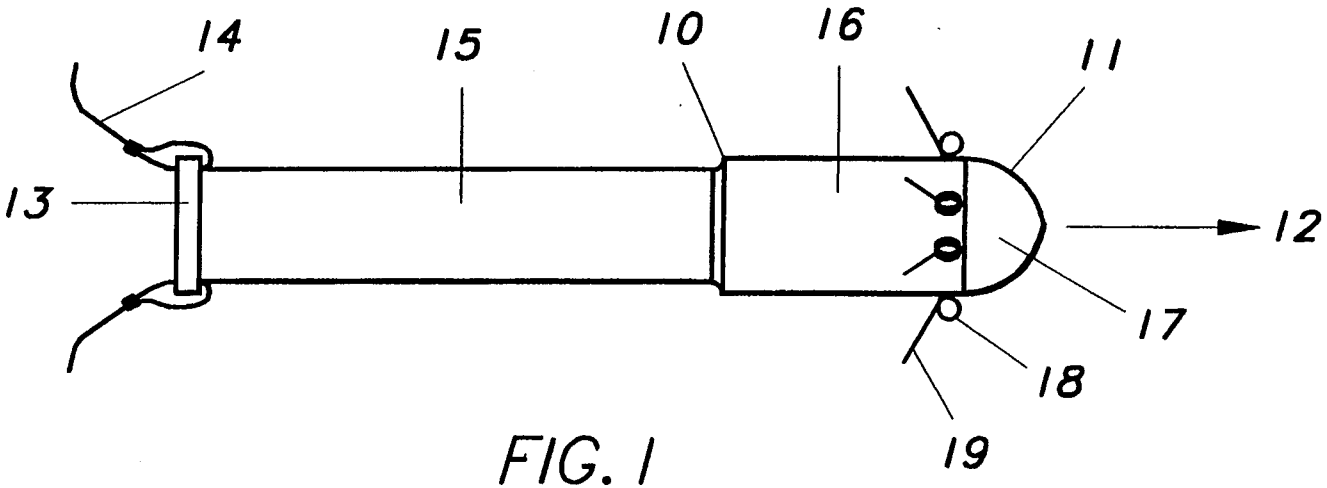
FIG. 1 is an external view of one embodiment of the invention.

FIG. 1 shows an external view of one embodiment of our invention, a muzzle launched grapnel hook projectile 10, providing an advantage not heretofore obtained with the present series of muzzle launched line throwing projectiles. The major components or parts of this new projectile include a projectile body 11, made of high strength to weight material such as heat treated aluminum. With respect to travel direction 12, there is a base flange 13. Attached to the base flange is a bridle comprising several bridle leaders 14. Each leader is secured to the base flange by looping through a drill hole and affixing the free end back onto the leader with a ferrule. Forward of the base flange is a lesser diameter cylindrical section 15, which serves to reduce the body weight in the region of lowest internal pressure. Forward of this lesser diameter section is a larger diameter front section 16, which provides the greatest body strength for retaining the highest internal gas pressure and the impact and deformation of the rifle bullet and bullet trap. At the front of the body is a nose section 17, which provides an aerodynamic contour and impact protection to the body when the projectile hits the ground. Attached to the front section of the body about the circumference are several torsion springs 18. One of the free ends of each torsion spring is secured to the projectile body. The second free end 19 of each torsion spring projects outward from the body towards the base at an acute angle, and serves as a prong for grabbing trip wires as the projectile is retrieved.

Figure 2:
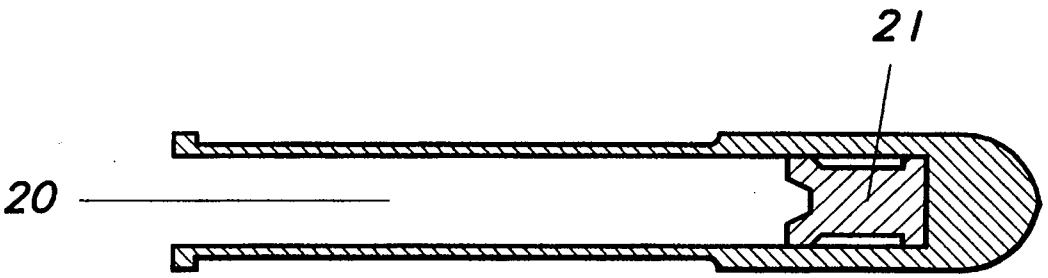
FIG. 2 is a cross-sectional view of the embodiment of the invention shown in FIG. 1.

FIG. 2 shows a cross-sectional view of the projectile shown in FIG. 1. Inside the projectile body, opening towards the base, is an internal cavity 20. The dimensions of this internal cavity are sized so that the projectile will slide over the free end of a standard military rifle or spigot muzzle launching device. At the front end of the internal cavity is a bullet trap 21. The bullet trap serves to catch and retain bullets fired from live rifle cartridges, when used as the propulsion mechanism for launching the projectile. If the bullet is made with a soft lead filler, the bullet trap can be made from aluminum alloy and configured to expand and deform, thus absorbing the bullet mass, energy, and fragments during bullet breakup and penetration. If the bullet is made with a steel core, as is the case with armor piercing bullets, the aluminum bullet trap is insufficient to safely stop the steel core. Under these circumstances, a hardened steel cup-shaped anvil is placed behind the aluminum bullet trap, in the direction of penetration. The steel anvil is sufficiently strong to retain the steel core bullet without deforming and damaging the projectile body, and the aluminum bullet trap serves to slow down the steel core bullet and prevent bullet fragments from flying back out.

Figure 3:
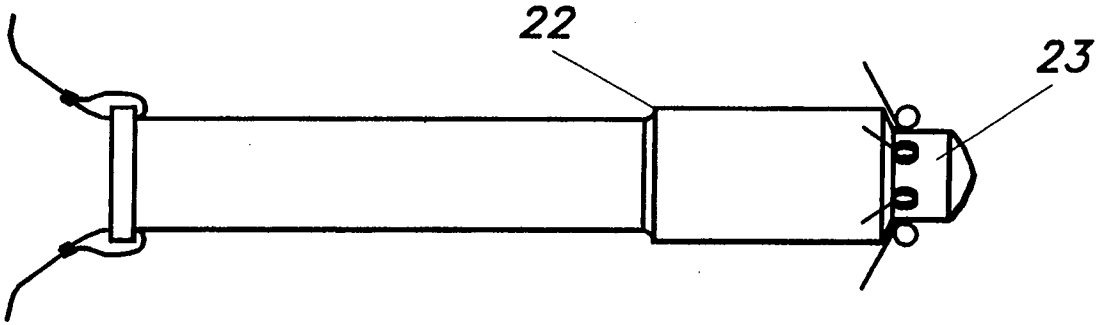
FIG. 3 is an external view of another embodiment of the invention.

FIG. 3 shows an external view of another embodiment of our invention, a muzzle launched grapnel hook projectile 22. This configuration is different from that in FIG. 1 with the addition of a lesser diameter nose section 23. By under-cutting this nose section and mounting the torsion springs on this lesser diameter surface, the spring coils are better protected from damage when the projectile impacts the ground. Recessing the torsion springs in this manner also reduces the force necessary to open the spring when it snags on a thin obstacle, such as barbed wire, since the opening force now has a greater moment arm.

Figure 4:
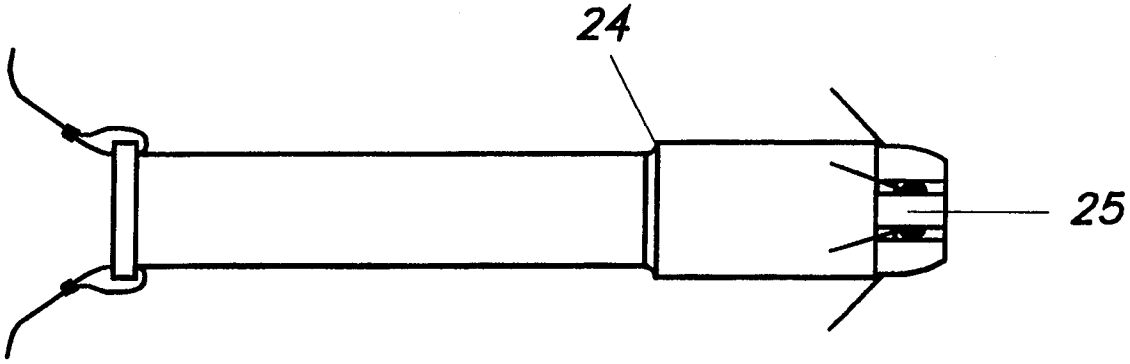
FIG. 4 is an external view of still another embodiment of the invention.
Figure 5:
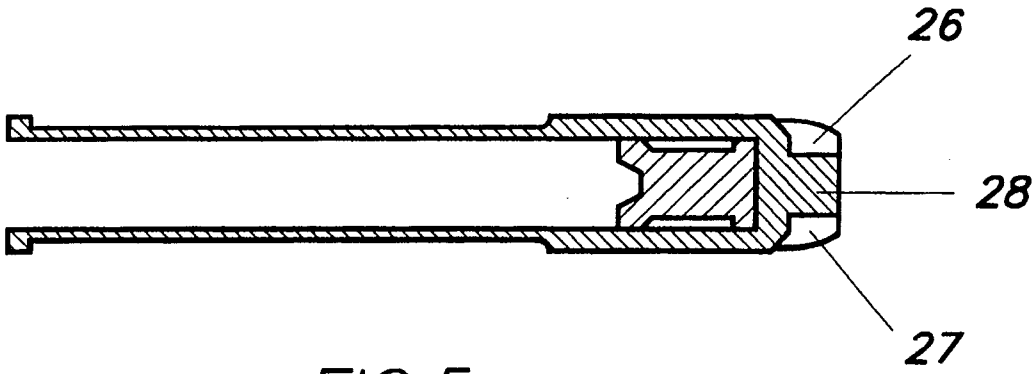
FIG. 5 is a cross-sectional view of the embodiment of the invention shown in FIG. 4.

FIG. 4 shows an external view of another embodiment of our invention, a muzzle launched grapnel hook projectile 24. This configuration is different from that in FIG. 1 and FIG. 3 with the addition of longitudinal gussets 25 located about the circumference of the body between each of the torsion springs. These gussets provide additional circumferential strength between the torsion springs so that they are not deflected laterally during impact with the ground or while opening during release from an obstacle. The torsion spring coils are also recessed below the greatest diameter of the body, again for more protection and to reduce the force necessary to open the spring and release it from a thin obstacle. FIG. 5 shows a cross-sectional view of the projectile body shown in FIG. 4. Longitudinal gussets 26 and 27 are shown integrally attached about the reduced diameter surface of nose section 28. Depending on the diameter of the spring coil, diameter of nose section 28 may disappear, leaving only gussets. In this case, the torsion spring is secured into longitudinal drill holes into the thickness of the projectile body. Torsion spring design is sufficiently flexibly to permit many different mounting configurations on the projectile body.

Figure 6:
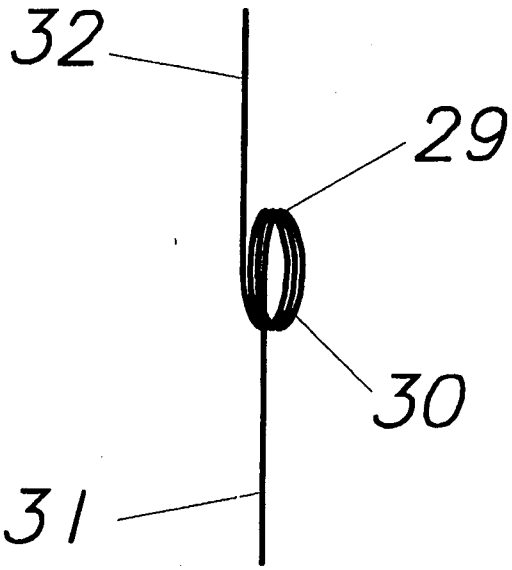
FIG. 6 is a view of one embodiment of the torsion spring used as a tine in this invention.

FIG. 6 shows one embodiment of a torsion spring 29 used in this invention as a tine to snag trip wires and to open and release from non-trip wire obstacles while the projectile is being retrieved. The torsion spring in FIG. 6 is comprised of spring coil 30. Protruding from the coil are prong free end 31 and secured free end 32. Secured free end 31 is secured into a drill hole in the projectile body and prong free end 32 acts as a prong to grab trip wires and to release from obstacles along the retrieval path. As a force is applied to prong free end 32, coil 30 deflects circumferentially permitting the angle between prong free end 31 and secured free end 32 to open, thus releasing the obstacle.

Figure 7:
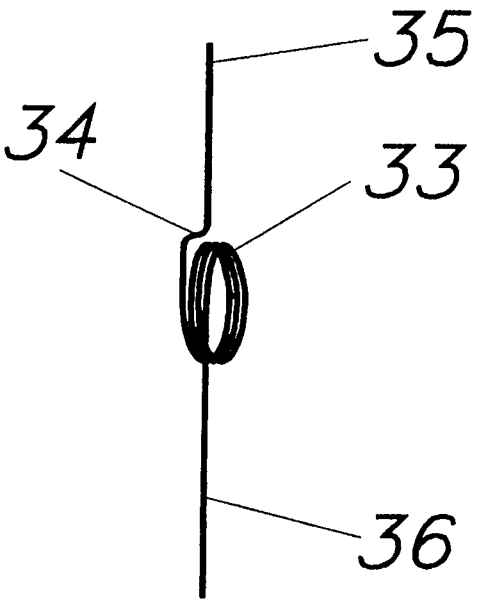
FIG. 7 is a view of another embodiment of the torsion spring used as a tine in this invention.

FIG. 7 shows another embodiment of a torsion spring 33 used as a tine in this invention. This torsion spring is significantly different from torsion spring 29 in FIG. 6 by the addition of bend 34 in prong free end 35. This bend brings prong free end 35 in line with secured free end 36, which is secured to the projectile body. As a result, when an opening force is applied to the prong free end, the spring coil will not rotate about the secured free end. Without this additional bend, spring coil 30 in FIG. 6 will begin to rotate about secured free end 31. If the spring coil rotates about the secured free end, the spring ceases to act as a torsion spring and begins to act as a weaker and less controllable extension coil spring. Bend 34 in torsion spring 33 is advantageous for maintaining the greatest and most consistent spring stiffness during opening.

Figure 8:
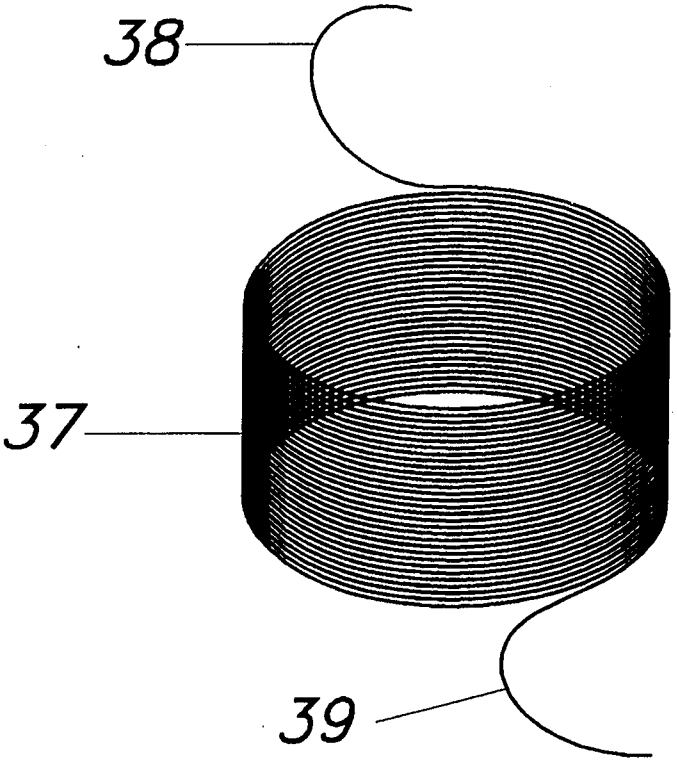
FIG. 8 is a view of one embodiment of the retrieval line spool used in this invention.
Figure 9A:
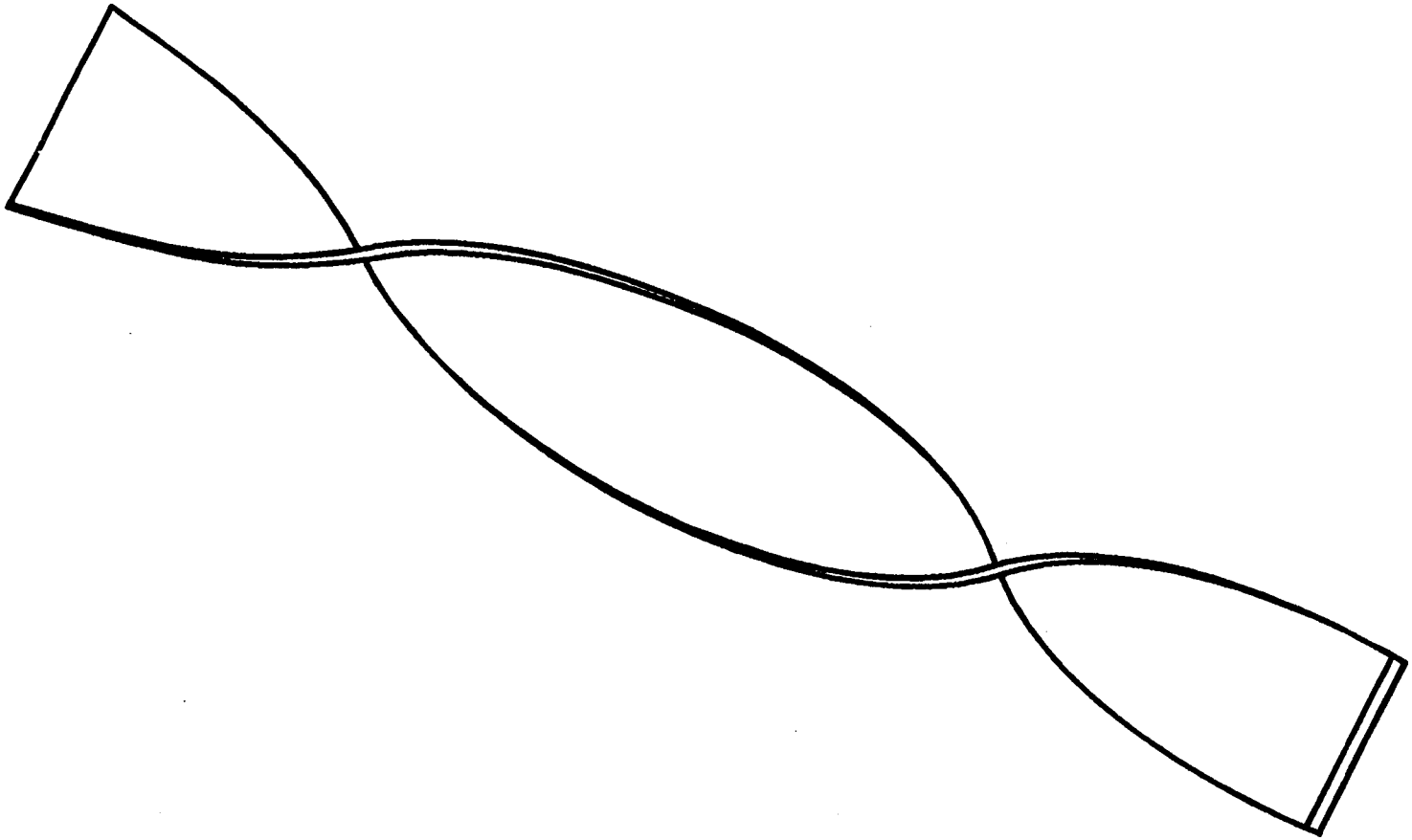
FIG. 9A is a view of the twisted ribbon structure of the retrieval line shown in FIG. 9.

FIG. 8 shows one embodiment of a retrieval line spool 37 used to pull the grapnel hook projectile back to the launch point in order to snag trip wires. Retrieval line free end 38 is attached to the bridle leaders, and free end 39 is restrained by the shooter at the launch point. Retrieval line spool 37 is configured to dispense the retrieval line with minimal friction and resistance to the projectile flight when using a heavy duty mono-filament plastic line made from nylon, polypropylene, or another plastic material. Line diameters from one to two millimeters provide sufficient strength with acceptable weight penalty. The spool is wound one strand of line thick in a cylindrical coil shape, so that it always deploys from the end of the spool. Mono-filament line can be coiled in this shape by wrapping the line about a cylindrical mandrel and then heating. After cooling, the line will take a permanent set to the mandrel diameter and will naturally coil as desired. After retrieving the projectile, this line will recover to its original coiled shape, and the grapnel hook projectile and line can be re-used with a blank propellant cartridge.

Figure 9:
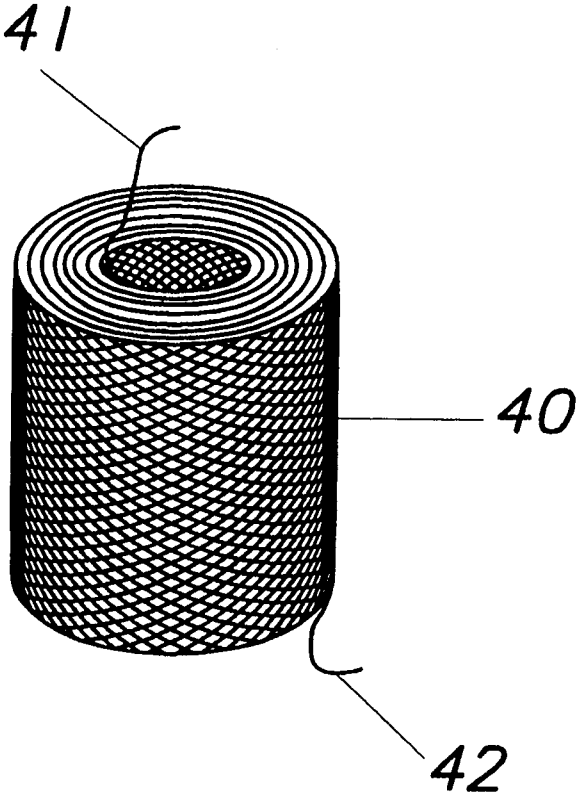
FIG. 9 is a view of another embodiment of the retrieval line spool used in this invention.

FIG. 9 shows another embodiment of a retrieval line spool 40 used to pull the grapnel hook projectile back to the launch point in order to snag trip wires. Retrieval line free end 41 is attached to the bridle leaders. Free end 41 is pulled out from the inside of the spool. The outside free end 42 is restrained by the shooter at the launch point. However, when firing this retrieval line spool, the line pulls out so smoothly from the inside that the spool will not move at all even when laid unrestrained on the ground. Retrieval line spool 40 is configured to deploy the retrieval line with minimal friction and resistance to the projectile flight when using a twisted ribbon plastic line material. The twisted ribbon plastic line is wound with a coreless center so that the line pulls out from the inside. A coreless wind coupled with the very slippery properties of twisted ribbon plastic result in negligible friction. Only a twisted ribbon plastic material works efficiently with this retrieval line spool configuration FIG. 9.A shows the twisted ribbon structure of this retrieval line material. The advantage of using twisted ribbon plastic for the retrieval line is that a very long length of line can be packaged into a very small spool. Although retrieval line spool 40 is intricately wound on a machine, while retrieving the projectile, the twisted ribbon plastic line can be carefully piled and the grapnel hook projectile and line can be re-used with a blank propellant cartridge. The twisted ribbon plastic is so slippery that it will pull out from the pile without snagging.

The reader will see that the projectile of the invention provides effective, unique, highly efficient, and useful mechanisms for safely detonating trip wire mines. These mechanisms include a muzzle launched grapnel hook projectile, which can be used once with a live bullet and multiple times with blank propellant cartridges as the propulsion force; a retrieval line spool that deploys the retrieval line with minimal resistance to projectile flight and range, and the retrieval line can be reused after pulling the grapnel hook projectile back to the launch point; a bridle assembly connecting the retrieval line to the base flange of the projectile, with the bridle comprising a system of multiple leaders to form a cone-like surface so that the base of the projectile can easily slide over obstacles as it is being retrieved; and a system of multiple torsion springs attached to the front of the projectile, with each spring free end acting as a prong to snag trip wires, but releasing from other obstacles as the projectile is dragged back to the launch point.

It is intended that our invention be utilized with a wide range of firearms, including commercial, standard military, and specialized rifles and spigots, using a wide range of live bullet and blank propellant cartridges as the propulsion force. If a propulsion mechanism is not available, this grapnel hook projectile may also be sent downrange with the traditional grapnel throwing technique of twirling it overhead on several feet of retrieval line and then releasing with sufficient speed to fly several dozen yards.

Many different bullet trap configurations can be used to safely stop and retain different bullet types. These bullet traps may consist of simple aluminum plugs which stop lead core bullets, to more complicated bullet traps comprising aluminum plugs, steel anvils, and small shock absorbing pistons, which stop armor piercing and other steel core bullets, and reduce the maximum launch accelerations. It is intended that our invention be utilized with a wide range of bullet trap assemblies, applicable to the bullet cartridges being employed as the propulsion force.

Alternate configurations for placing, orienting, and shaping of the tine torsion springs and prongs exist, each give different opening forces and spring responses as they release from obstacles. There exist many alternatives for recessing the torsion spring coils for greater damage resistance when the projectile impacts the ground. There exist many possible embodiments of the unique and useful advantages of our invention.

We claim:

1. A line carrying projectile for clearing mines having trip wires; said projectile having a body, a retrieval line, and a plurality of torsion springs disposed about said projectile body for engaging said mine trip wires.

2. The line carrying projectile in claim 1 wherein said retrieval line is made from twisted ribbon plastic material; said retrieval line is wound into a spool having a coreless center; and said retrieval line deploys by pulling out from said coreless center.

3. The line carrying projectile in claim 1 wherein said retrieval line is made from mono-filament plastic material; said retrieval line is wound into a coil shaped spool.

4. The line carrying projectile in claim 1 wherein said body has a base and an internal cavity opening at said base; said internal cavity is sized to fit over a muzzle end of a firearm.

5. The line carrying projectile in claim 1 wherein said body has a base and an internal cavity opening at said base; said internal cavity is sized to fit over a muzzle end of a firearm; and inside said internal cavity is a means for stopping and retaining a bullet which has been fired into said internal cavity.

6. The line carrying projectile in claim 1 wherein said body has a base and an external flange disposed about said base; disposed about said external flange is a plurality of leader lines; and said leader lines form a connection for attaching said retrieval line to said body.

7. The line carrying projectile in claim 1, wherein said retrieval line is made from plastic material selected from the group consisting of polypropylene and nylon.

8. A line carrying projectile for clearing mines having trip wires; said projectile having a body, a retrieval line, and a plurality of torsion springs disposed about said projectile body; and each of said torsion springs having a spring coil and a free end for engaging said mine trip wires.

9. The line carrying projectile in claim 8 wherein said free end is substantially straight.

10. The line carrying projectile in claim 8 wherein said free end has a bend.

11. The line carrying projectile in claim 8 wherein said retrieval line is made from twisted ribbon plastic material; said retrieval line is wound into a spool having a coreless center; said retrieval line deploys by pulling out from said coreless center; and said spool has self-supporting means without an external container or a center mandrel.

12. The line carrying projectile in claim 8 wherein said retrieval line is made from mono-filament plastic material; said retrieval line is wound into a coil shaped spool; and said spool has self-supporting means without an external container or a center mandrel.

13. The line carrying projectile in claim 8 wherein said body has a base and an internal cavity opening at said base; said internal cavity is sized to fit over a muzzle end of a firearm; and said firearm providing propulsive means for said projectile.

14. The line carrying projectile in claim 8 wherein said body has a base and an internal cavity opening at said base; said internal cavity is sized to fit over a muzzle end of a firearm; said firearm providing propulsive means for said projectile; and inside said internal cavity is a means for stopping and retaining a bullet which has been fired into said internal cavity.

15. The line carrying projectile in claim 8 wherein said body has a base and an external flange disposed about said base; disposed about said external flange is a plurality of leader lines; said leader lines form a connection for attaching said retrieval line to said body; and said leader lines provide means for passing said base over objects when retrieving said projectile.

16. The line carrying projectile in claim 8 wherein said retrieval line is made from plastic material selected from the group consisting of polypropylene and nylon.

17. A line carrying projectile for clearing mines having trip wires; said projectile having a body and a retrieval line; said retrieval line being made from plastic material; said body having a base and an external flange disposed about said base; a plurality of leader lines disposed about said external flange; said leader lines providing means for connecting said retrieval line to said projectile; said body having an internal cavity opening at said base; a plurality of torsion springs disposed about said projectile body; and each of said torsion springs having a spring coil and a free end for engaging said mine trip wires.

18. The line carrying projectile in claim 17 wherein said free end is substantially straight.

19. The line carrying projectile in claim 18 wherein said retrieval line is made from twisted ribbon plastic material; said retrieval line is wound into a spool having a coreless center; said retrieval line deploys by pulling out from said coreless center; and said spool has self-supporting means without an external container or a center mandrel.

20. The line carrying projectile in claim 18 wherein said retrieval line is made from mono-filament plastic material; said retrieval line is wound into a coil shaped spool; and said spool has self-supporting means without an external container or a center mandrel.

* * * * *